US006679578B2

(12) United States Patent
Arakawa

(10) Patent No.: US 6,679,578 B2
(45) Date of Patent: Jan. 20, 2004

(54) INK-JET RECORDING APPARATUS

(75) Inventor: Masayuki Arakawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/179,270

(22) Filed: Jun. 26, 2002

(65) Prior Publication Data

US 2002/0196307 A1 Dec. 26, 2002

(30) Foreign Application Priority Data

Jun. 26, 2001 (JP) ..... 2001-193632

(51) Int. Cl.[7] ..... B41J 2/165
(52) U.S. Cl. ..... 347/33
(58) Field of Search ..... 347/22, 24, 29, 347/30, 32, 33; 15/250, 361; 101/155

(56) References Cited

U.S. PATENT DOCUMENTS

| | | | | |
|---|---|---|---|---|
| 5,381,169 A | * | 1/1995 | Arai et al. | 347/33 |
| 5,555,461 A | * | 9/1996 | Ackerman | 347/33 |
| 5,905,513 A | | 5/1999 | Brandon et al. | |
| 6,467,873 B1 | * | 10/2002 | Toba et al. | 347/33 |
| 6,565,188 B1 | * | 5/2003 | Saito | 347/33 |

FOREIGN PATENT DOCUMENTS

| | | | |
|---|---|---|---|
| EP | 0 494 693 B1 | | 7/1992 |
| EP | 0 581 553 A2 | | 2/1994 |
| EP | 0 841 168 A2 | * | 5/1998 |
| JP | A 4-37556 | | 2/1992 |
| JP | B2 4-77670 | | 12/1992 |
| JP | A 6-115065 | | 4/1994 |

* cited by examiner

*Primary Examiner*—Shih-wen Hsieh
(74) *Attorney, Agent, or Firm*—Oliff & Berridge, PLC

(57) ABSTRACT

In an ink-jet printer, a support member includes a wiper cleaning zone provided upstream of a wiping direction of a nozzle surface. The wiper cleaning zone includes a cleaning wall, a first surface, and a plurality of grooves. The cleaning wall protrudes from the support member. The first surface extends in a direction reverse to the wiping direction, continuously from the cleaning wall. The plurality of grooves are provided in the first surface, extending from the cleaning wall. The grooves are formed at a predetermined distance from each other and hold ink therein by capillary action. Ink, adhered to a wiper by wiping operation, is rubbed by the cleaning wall provided in the wiper cleaning zone, and the collected ink is held by the grooves continuously formed from the cleaning wall. A similar, but reversed, structure is found on the other side of the nozzle surface in the wiping direction.

25 Claims, 12 Drawing Sheets

INK-JET RECORDING APPARATUS

BACKGROUND OF THE INVENTION

1. Field of Invention

The invention relates to an ink-jet recording apparatus, and more particularly, to an ink-jet recording apparatus wherein ink adhered to a wiper can be surely wiped therefrom with a simple structure and the ink collected from the wiper can be prevented from dripping and scattering.

2. Description of Related Art

An ink-jet recording apparatus is a kind of image forming apparatus that forms an image on a recording medium, such as a recording sheet and an overhead transparency film, by ejecting ink droplets from a plurality of nozzles provided in an ink-jet head. In the ink-jet recording apparatus, ink may adhere to a nozzle surface when ink is ejected or deteriorated ink is purged from the nozzles. If ink droplets are ejected from the nozzles to form an image with the ink adhered to the nozzle surface, the ink droplets may be ejected in an improper direction. This may cause a printing failure. The ink adhered to the nozzle surface may make the recording medium dirty, resulting in a reduction in printing quality. Further, adhesion of paper dust to the nozzle surface may also cause ink to be ejected in an improper direction, thereby decreasing the printing quality.

In order to recover the ink ejecting condition of the ink-jet head and to prevent the recording medium from getting dirt thereon, a wiping operation is performed on the nozzle surface, to remove the ink and paper dust adhered thereon, at regular time intervals or after a purging operation. The wiping operation is performed using an elastic wiper. While the wiper is pressed against the nozzle surface, the ink-jet head is moved so as to be wiped by the wiper to clean the nozzle surface.

As a matter of course, ink wiped from the nozzle surface of the ink-jet head adheres to the wiper after the wiping operation. If a wiping operation is performed using the wiper having the collected ink thereon, the wiper cannot completely wipe off the ink adhering to the nozzle surface. Further, the ink, which adheres to the wiper and has a high viscosity, may be spread over the nozzle surface by the wiping operation. This makes the nozzle surface dirty and causes the nozzles to be clogged with contaminants and ink having high viscosity, thereby causing ink ejection failure. In order to resolve those problems, an ink-jet recording apparatus has been proposed that has a mechanism for cleaning a wiper separately or an ink absorbing member made of a material having absorbency, to remove ink adhering to the wiper. However, with this structure, the ink-jet recording apparatus becomes complicated, resulting in increased production costs for the ink-jet recording apparatus.

U.S. Pat. No. 5,905,513 discloses an ink-jet recording apparatus as described below. In the ink-jet recording apparatus, a printhead includes a pair of wiper cleaning zones located on both sides of a nozzle plate. Each of the cleaning zones includes a plurality of ribs and a plurality of cavities, wherein at least one cavity is formed between adjacent ribs.

A wiper of a maintenance station is pressed against the nozzle plate of the printhead during a maintenance operation to clean excess ink and contaminants, such as paper dust, from the nozzle plate. In turn, the ribs and the cavities cooperate to remove and collect from the wiper the excess ink and contaminants removed from the nozzle plate.

Elevating members are provided immediately adjacent the wiper cleaning zones and between the wiper cleaning zones and the nozzle plate, and serve to lift the wiper from the plane of the surface of the ribs of a first cleaning zone to the plane of the outer surface of the nozzle plate for wiping and then to gently lower the wiper from the plane of the outer surface of the nozzle plate to the plane of the surface of the ribs in a second cleaning zone after wiping the nozzle plate. The outer surface of the ribs carries the wiper over the cavities.

SUMMARY OF THE INVENTION

The invention provides an ink-jet recording apparatus wherein ink adhered to a wiper can be further surely wiped therefrom with a simple structure so as not to again adhere the collected ink to the wiper and the ink wiped from the wiper can be prevented from dripping and scattering.

According to one aspect of the invention, an ink-jet recording apparatus includes an ink-jet head, a support member, a wiper, and a wiper cleaning zone. The ink-jet head has a nozzle surface having a plurality of nozzles therein and performs printing on a recording medium by ejecting ink from the nozzles. The support member supports the ink-jet head and reciprocates along the recording medium. The wiper protrudes within a moving path of the nozzle surface of the ink-jet head and wipes the nozzle surface when the support member moves in a first direction. The wiper cleaning zone is provided to the support member upstream of the nozzle wiping direction with respect to the nozzle surface of the ink-jet head. The wiper cleaning zone includes a cleaning wall, a first plane, and a plurality of grooves. The cleaning wall is provided adjacent to the ink-jet head and protrudes from the support member. The first plane is provided proximate the cleaning wall and extends in a direction reverse to the wiping direction. The plurality of grooves are provided in the first plane, at a predetermined distance from each other. In the ink-jet recording apparatus, the wiper does not contact the first plane, but contacts the cleaning wall, when the wiper protrudes within the moving path of the nozzle surface of the ink-jet head. The cleaning zone further includes a second plane inclined between the first plane and the cleaning wall to initially contact the wiper prior to the wiper contacting the cleaner wall.

With this structure, when the nozzle surface of the ink-jet head is wiped using the wiper, first, the wiper is pressed against the cleaning wall in the wiper cleaning zone provided upstream of the wiping direction, in accordance with the movement of the support member. Therefore, ink adhering to the wiper is wiped off by the cleaning wall. Then, the clean wiper is moved toward the nozzle surface to wipe the nozzle surface while pressed against the nozzle surface. The ink wiped from the wiper and collected on the cleaning wall is held in the plurality of grooves formed continuously from the cleaning wall by capillary action. The ink is held in the grooves so as not to touch the wiper, so that the ink will not adhere to the wiper again.

BRIEF DESCRIPTION OF THE DRAWINGS

An embodiment of the invention will be described in detail with reference to the following figures wherein.

DETAILED DESCRIPTION OF PREFERRED EMBODIMENTS

Figure 1:
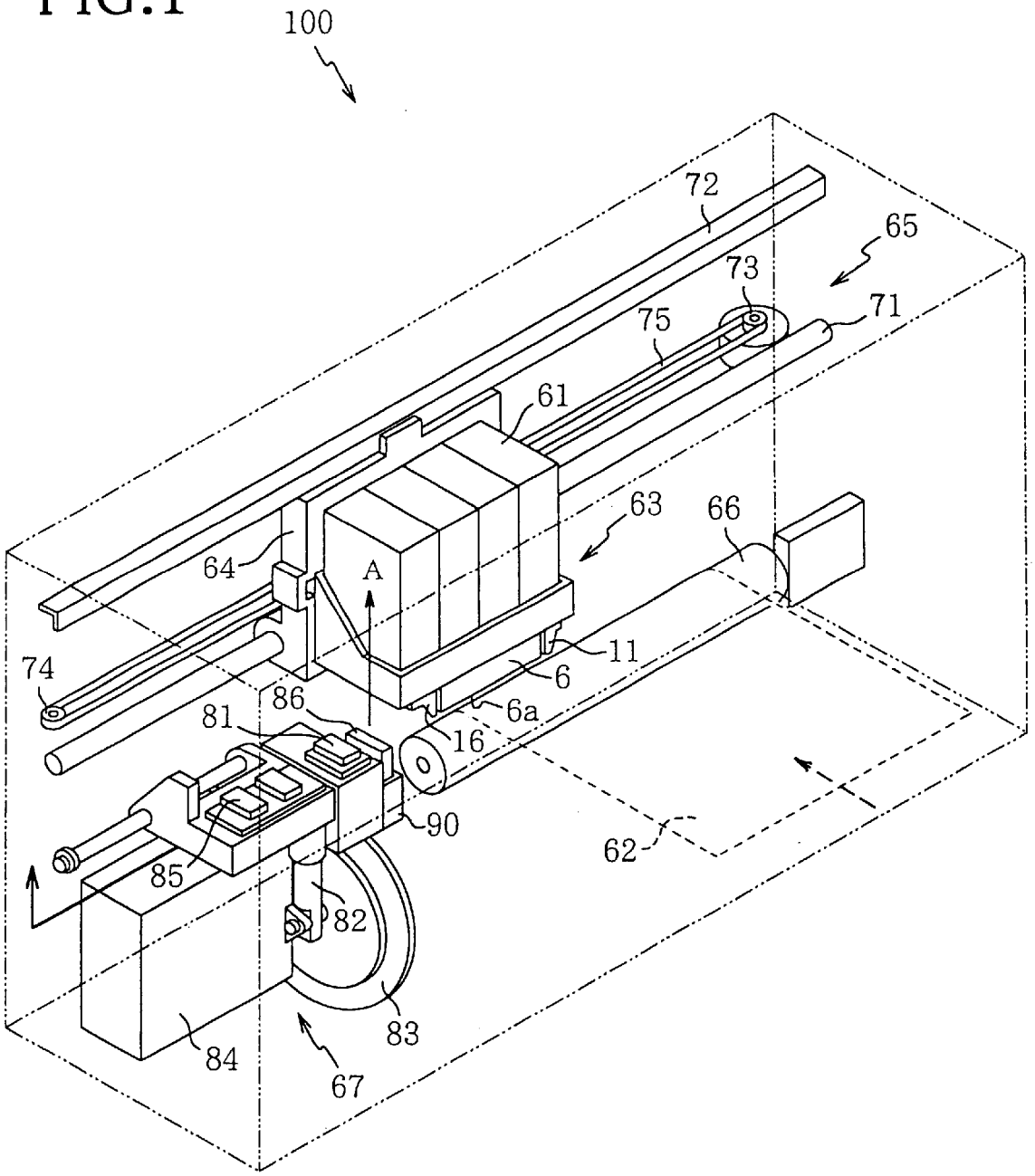
FIG. 1 is a perspective view showing an ink-jet printer of an embodiment of the invention.

An embodiment of the invention will be described with reference to the accompanying drawings. As shown in FIG. 1, a color ink-jet printer 100 includes four ink cartridges 61, a head unit 63, a carriage 64, a drive unit 65, a platen roller 66, and a purge unit 67. The ink cartridges 61 are each filled with a particular color of ink, such as cyan, magenta, yellow and black. The head unit 63 has an ink-jet print head 6 for performing printing on a sheet 62. The ink cartridges 61 and the head unit 63 are mounted on the carriage 64. The drive unit 65 reciprocates the carriage 64 in a straight line. The platen roller 66 extends in a carriage reciprocating direction and faces the ink-jet head 6.

The drive unit 65 includes a carriage shaft 71, a guide plate 72, two pulleys 73, 74 and an endless belt 75. The carriage shaft 71 is disposed at a lower end of the carriage 64 and extends in a direction parallel to the platen roller 66. The guide plate 72 is disposed at an upper end of the carriage 64 and extends in a direction parallel to the carriage shaft 71. The pulleys 73, 74 are disposed at both ends of the carriage shaft 71, between the carriage 64 and the guide plate 72. The endless belt 75 is stretched between the pulleys 73, 74. The carriage 64 is connected to the endless belt 75.

As the pulley 73 is rotated in normal and reverse directions by a motor (not shown), the carriage 64 connected to the endless belt 75 reciprocates in the straight line, along the carriage shaft 71 and the guide plate 72, according to the rotation in the normal and reverse directions of the pulley 73.

The sheet 62 is fed from a sheet cassette (not shown) provided in a side or a lower part of the color ink jet printer 100. The sheet 62, fed from the sheet cassette, is fed between a nozzle surface 6*a* of the ink-jet head 6, facing vertically downward, and the platen roller 66. The nozzle surface 6*a* has a plurality of nozzles, and ink droplets are ejected from the nozzles. A printing operation is performed on the sheet 62 between the nozzle surface 6*a* and the platen roller 66 by ejecting ink droplets from the ink-jet head 6. Then, the sheet 62 is discharged from the color ink jet printer 100. In FIG. 1, a sheet feeding mechanism and a discharging mechanism of the sheet 62 are omitted.

The purge device 67 is disposed next to the platen roller 66 extending along the carriage moving direction. In the ink-jet head 6, ejection failure may be caused by air bubbles developed in the ink and by ink and paper dust adhered to the nozzle surface 6*a* of the ink-jet head 6. The purge device 67 serves to recover the ink-jet head 6 from impaired ejecting conditions.

The purge device 67 includes a purge cap 81, a pump 82, a cam 83 and a waste ink reservoir 84. When the head unit 63 is placed in a purge position, the purge device 8 is opposed to an ink-jet head 6. The purge cap 81 intimately contacts the nozzle surface 6*a* of the ink-jet head 6 to allow the inhalation of ink and air bubbles trapped in the print head 3 using the pump 15. The suction by the pump 82 is performed by rotating the cam 83 to reciprocate a piston (not shown) provided in the pump 82. As described above, the ink-jet head 6 is recovered from impaired ejecting conditions by sucking ink and air bubbles. The inhaled ink is stored in the waste ink reservoir 84.

A cap 85 is provided adjacent to the purge device 67 to cover the nozzles formed in the nozzle surface 6*a* of the ink-jet head 6 located in the reset position after printing, in order to prevent the ink from drying out.

A wiper 86 is provided adjacent to the purge device 67 on the side of the platen roller 66, and can move relative to the ink-jet head 6.

The wiper 86 has a paddle-shape, and is supported by a wiper holder 90 at its end. The wiper 86 is disposed so as to protrude toward the ink-jet head 6, and wipes contaminates, such as ink and paper dust, from the nozzle surface 6*a* of the ink-jet head 6 in accordance with the movement of the carriage 64. A direction of wiping the nozzle surface by the wiper 86 is reverse to the carriage moving direction (hereinafter, referred to as a wiping direction). The head unit 63 includes a wiper cleaning zone 11 and an ink holding zone 16 provided on opposite sides of the ink-jet head 6. When the head unit 63 is in the purge position, the wiper 86 is moved in a direction indicated by an arrow A to wipe the nozzle surface 6*a*. At that time, the wiper 86 is located on the side of the wiper cleaning zone 11 (upstream of the wiping direction). The wiper 86 wipes contaminants while being pressed against the nozzle surface 6*a*. Then, the wiper 86 is located on the side of the ink holding zone 16 (downstream of the wiping direction). After the wiping operation, the wiper 86 is moved in a direction reverse to the direction of the arrow A. While the wiping operation is not performed, the wiper 86 is retained in a position where the wiper 86 does not contact the nozzle surface 6*a*.

Figure 2:
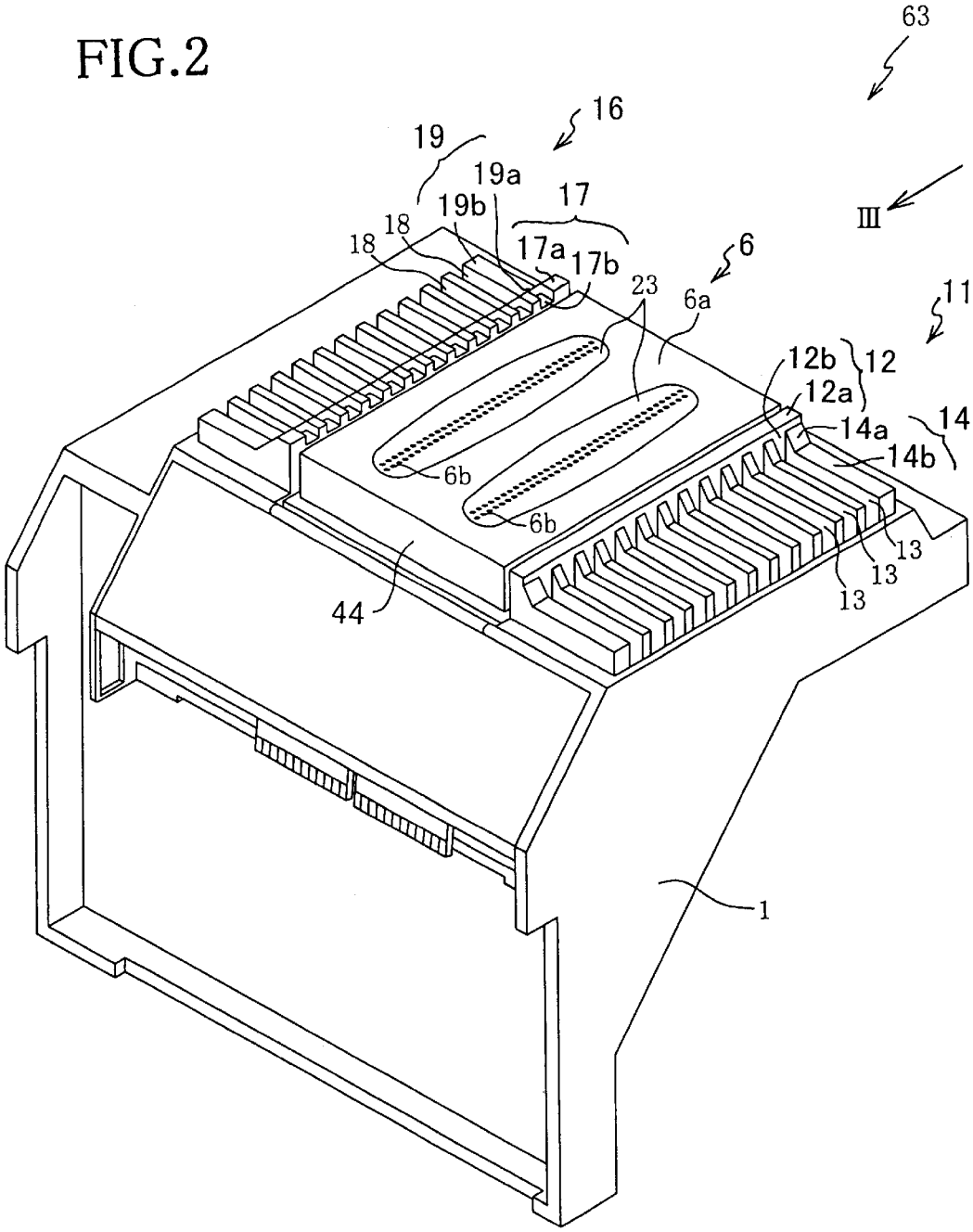
FIG. 2 is a perspective view of a head unit.

As shown in FIG. 2, the head unit 63 includes the ink-jet head 6 and a frame 1. The ink-jet head 6 has a plurality of nozzles 6*b*, which eject ink droplets therefrom, at its bottom. The frame 1 supports the ink-jet head 6.

The frame 1 is molded of synthetic resin material, such as polyethylene and polypropylene, and has a substantially box shape with upper open structure. The ink cartridges 61 are detachably attached into the opened space of the frame 1.

The frame 1 supports the rectangular ink-jet head 6 so as to protrude from the bottom of the frame 1 substantially at the middle. The frame 1 has the wiper cleaning zone 11 and the ink holding zone 16 on opposite sides of the ink-jet head 6.

The ink-jet head 6 includes a nozzle plate 23 and a cover plate 44. The nozzle plate 23 has the plurality of nozzles 6*b* for ejecting ink droplets therefrom. The cover plate 44 is made of a thin metal plate and covers the nozzle plate 23. The cover plate 44 has a substantially box shape with upper open structure and formed with two holes at its bottom. Portions formed with the nozzles 6*b* of the nozzle plate 23 are exposed to the outside from the holes, and thus ink droplets can be ejected from the nozzles 6*b*. The nozzle surface 6*a* of the ink-jet head 6 is substantially flat and includes the surface of the nozzle plate 23 having the nozzles 6*b* and the bottom of the cover plate 44. The nozzle surface 6*a* is made ink-repellent so that ink adhered to the nozzle surface 6*a* can be easily wiped off.

The wiper cleaning zone 11 is integral with the frame 1, and cleans the wiper 86 before the wiping operation. The wiper cleaning zone 11 includes a cleaning wall 12 and a plurality of grooves 13. The cleaning wall 12 is disposed adjacent to the ink-jet head 6 so as to protrude from the frame 1. The plurality of grooves 13 are provided continuously from the cleaning wall 12 so as to extend in a direction opposite to the wiping direction.

Figure 4:
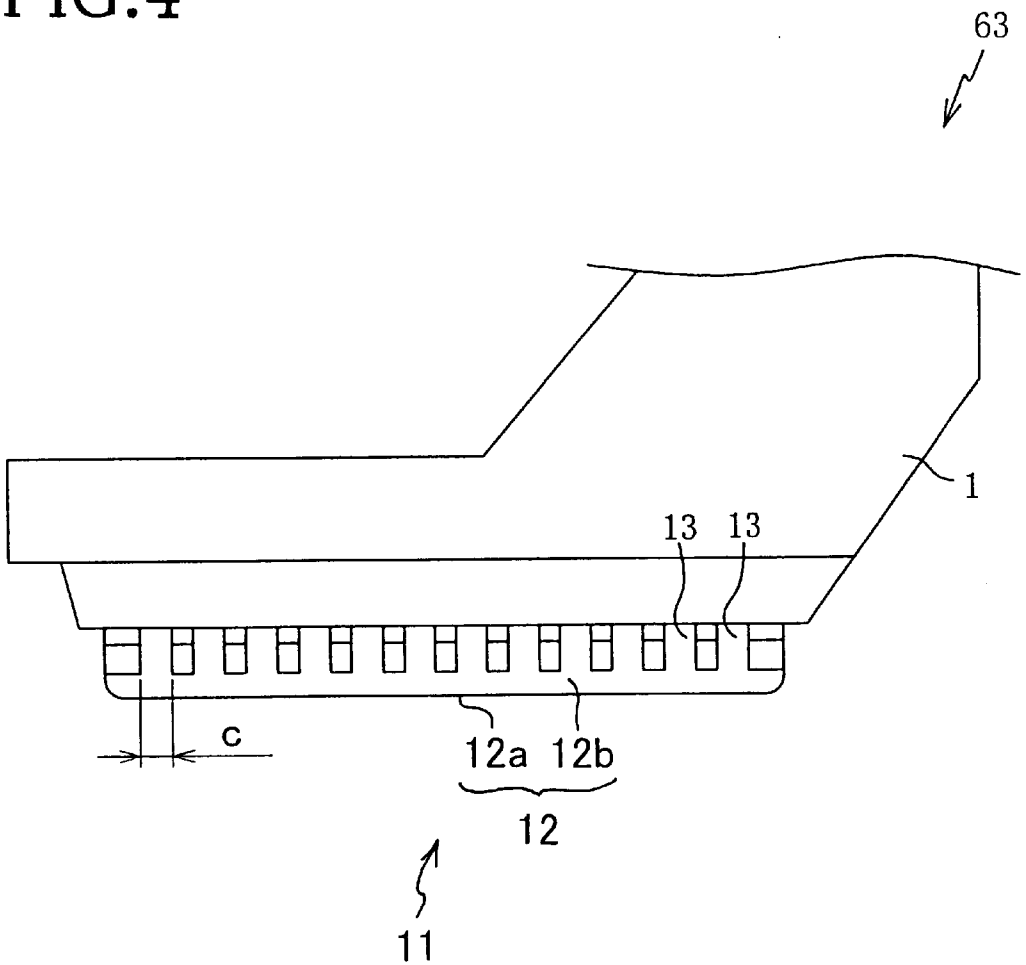
FIG. 4 is a right side view of the head unit, looking in a direction indicated by an arrow IV of FIG. 3.

The cleaning wall 12 rubs contaminants, such as ink and paper dust, from the wiper 86. The plate-shape cleaning wall 12 has an end face 12*a* and a side 12*b*. As shown in FIG. 4, the end face 12*a* of the cleaning wall 12 is provided at substantially the same level as the nozzle surface 6*a*. The wiper 86 is cleaned by rubbing with a part of the end face 12*a*.

Figure 3:
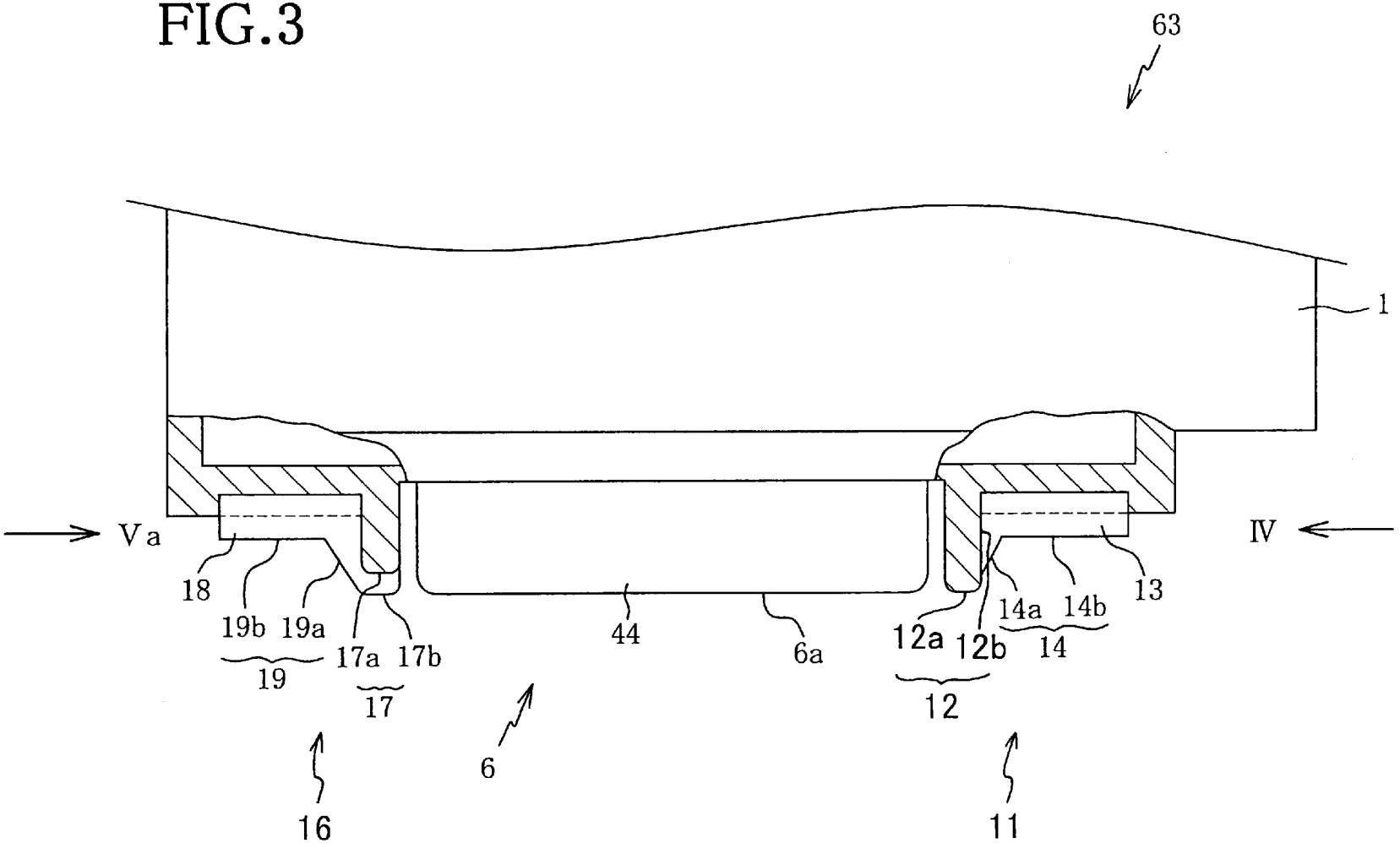
FIG. 3 is a front view of the head unit, looking in a direction indicated by an arrow III of FIG. 2.

The grooves 13 hold therein ink collected from the wiper 86 when rubbed against the cleaning wall 12. As shown in FIGS. 2 and 3, the grooves 13 are formed in a first surface 14 which is provided at a lower level than the end face 12*a* of the cleaning wall 12. The grooves 13 extend from the side 12*b* of the cleaning wall 12 in the direction opposite to the wiping direction, and are provided at regular intervals, in parallel to each other. The first surface 14 having the grooves 13 extends continuously from the side 12*b* of the cleaning wall 12. The first surface 14 has an inclined plane 14*a* and a plane 14*b*. The height of the inclined plane 14*a* gradually and continuously diminishes in the direction opposite to the wiping direction. The plane 14*b* extends from the end of the inclined plane 14*a*, in parallel with the nozzle surface 6*a* of the ink-jet head 6, toward the side of the frame 1. When the wiper 86 protrudes within a moving path of the ink-jet head 6 at the wiping operation, the free end of the wiper 86 contacts a part of the inclined plane 14*a* formed immediately adjacent to the cleaning wall 12 only, but does not contact the plane 14*b*.

The ink holding zone 16 is integral with the frame 1, and holds the ink collected by the wiping operation. The ink holding zone 16 includes a projection 17 and a plurality of grooves 18. The plurality of grooves 18 extend in the wiping direction from the projection 17.

The projection 17 is provided adjacent to the ink-jet head 6. The height of the projection 17 is substantially the same level as the projection amount of the nozzle surface 6*a* of the ink-jet head 6. A plurality of recesses 17*a* are formed in the end of the projection 17 at predetermined intervals to hold ink. As shown in FIG. 5B, the end of the projection 17 has intermittent projecting surfaces 17*b*.

The grooves 18 hold ink received by the recesses 17*a*. The grooves 18 extend in the wiping direction from the projection 17 and are provided at regular intervals and parallel to each other. A second surface 19 extends continuously from the projection 17 in the wiping direction. The grooves 18 are formed in the second surface 19. The second surface 19 has an inclined plane 19*a* and a plane 19*b*. The inclined plane 19*a* extends from the end face 17*b*, and the height of the inclined plane 19*a* gradually and continuously diminishes in the wiping direction. The plane 19*b* extends from one end of the inclined plane 19*a* and is parallel to the nozzle surface 6*a*. When the wiper 86 protrudes within the moving path of the ink-jet head 6 during the wiping operation, the free end of the wiper 86 contacts a part of the inclined plane 19*a* formed immediately adjacent to the projection 17 only, but does not contact the plane 19*b*.

Figure 5A:
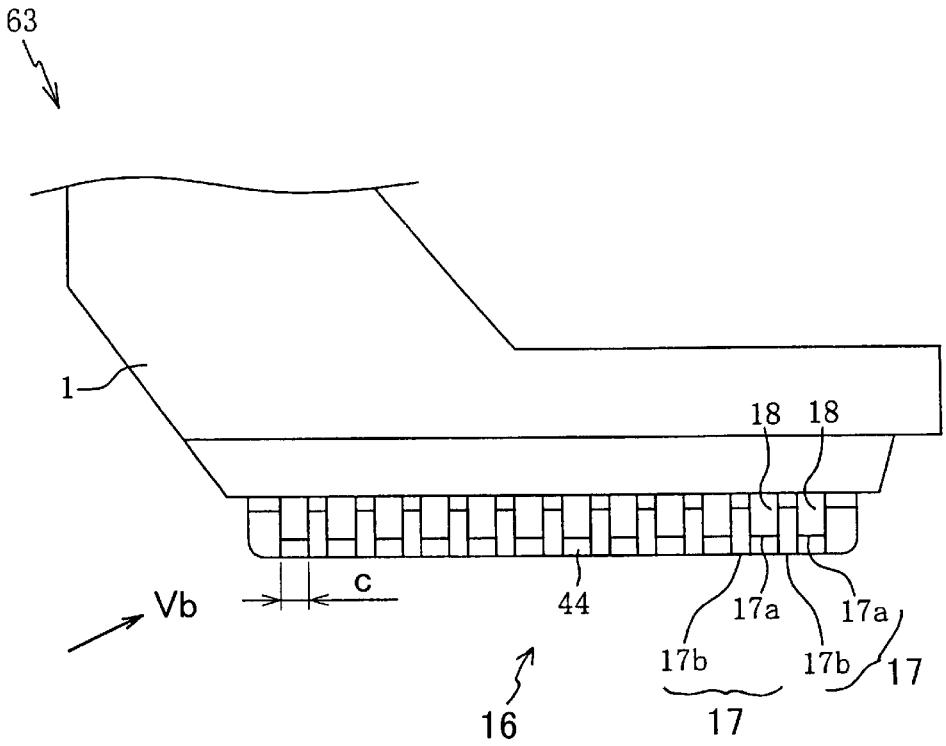
FIG. 5A is a left side view of the head unit, looking in a direction indicated by an arrow Va of FIG. 3.
Figure 5B:
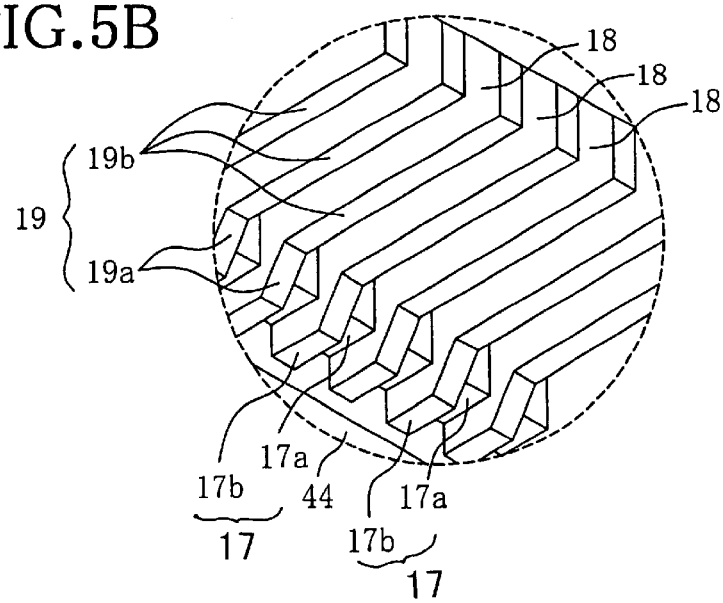
FIG. 5B is a perspective view of the head unit, looking in a direction indicated by an arrow Vb of FIG. 5A.

As shown in FIGS. 4 and 5A, an opening width C of the recesses 17*a* and the grooves 13, 18 is approximately 2 mm in this embodiment. In each of the recesses 17*a* and the grooves 13, 18, the opening width C becomes slightly narrow with depth. Therefore, ink caught in the recesses 17*a* and the grooves 13, 18 can be held by the bottom of the grooves 13, 18, which is a position apart from the surfaces of the first and second surfaces 14, 19. In the embodiment, while the opening width C is 2 mm, the width C can be changed. For example, when the viscosity of ink is thick or the traveling speed of the ink-jet head 6 is slow, the width C can be wider. On the other hand, when the viscosity of the ink is thin or the traveling speed of the ink-jet head 6 is fast, the width C can be narrower.

Next, the wiping operation will be described with reference to FIGS. 6A to 6C. The wiping operation is performed to eliminate contaminants, such as ink W and paper dust adhered to the nozzle surface 6*a* of the ink-jet head 6 after the purging operation performed by the purge device 67.

Figure 6A:
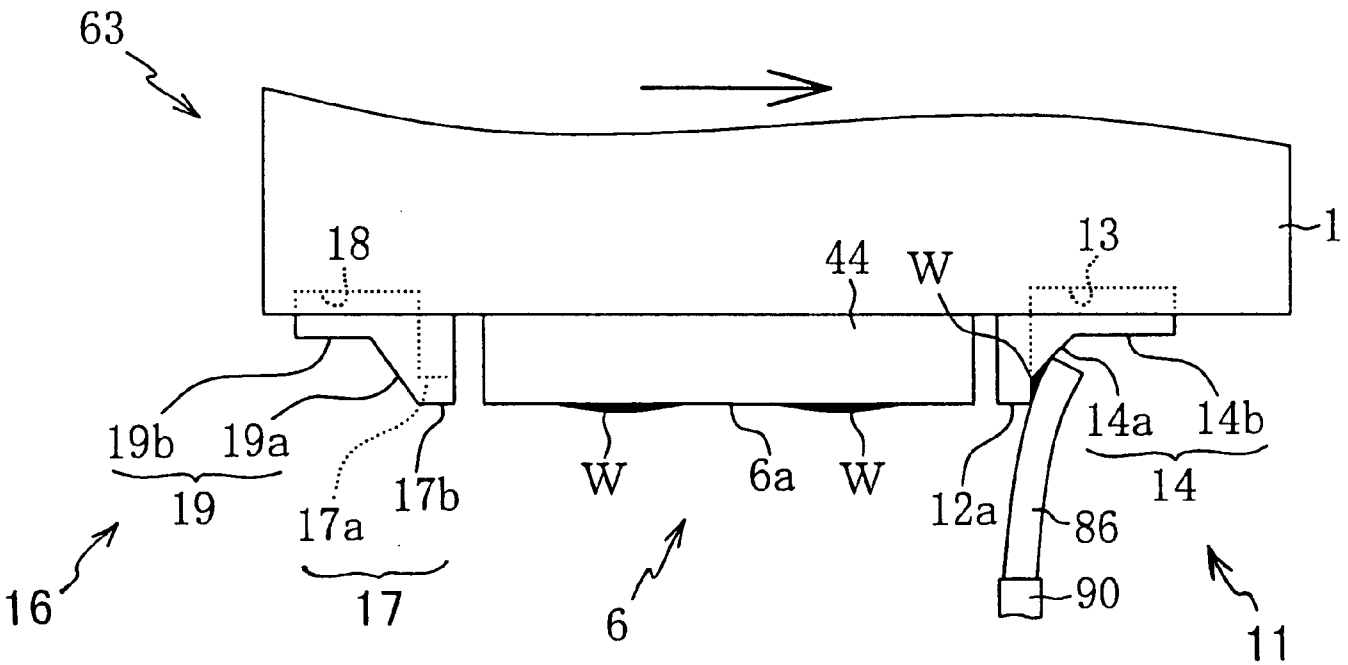
FIGS. 6A to 6C are front views showing movement of the head unit during the wiping operation.

As shown in FIG. 6A, after the purging operation, ink W sucked from the nozzles 6*b* remains on the nozzle surface 6*a* of the ink-jet head 6. Therefore, the ink-jet head 6 is moved toward the wiper 86 adjacent to the purge device 67 to performing the wiping operation. When the purging operation is completed, the wiper 86 is moved to a protruding position, where the wiper 86 protrudes within the moving path of the ink-jet head 6 and can contact the nozzle surface 6*a*, from a standby position, where the wiper 86 is located lower than the moving path of the ink-jet head 6, by control of the cam 83. First, the inclined plane 14*a* of the wiper cleaning zone 11 contacts the wiper 86 and then the cleaning wall 12 contacts the wiper 86. The contact portion of the cleaning wall 12 and the wiper 86 is moved toward the free end of the wiper 86 while the wiper 86 is deformed in order to rub the contact portion of the wiper 86. By capillary action, caused by the grooves 13, the ink W, collected from the wiper 86 and adhered to the cleaning wall 12, is led to the grooves 13 and held in the grooves 13 continuously formed from the side 12*b* of the cleaning wall 12. Thus, the collected ink W will not remain on the cleaning wall 12 that contacts the wiper 86. Accordingly, the wiper 86 can be rubbed by the cleaning wall 12, on which no ink remains, at any time, when the wiping operation is performed. Thus, ink W adhered to the wiper 86 can be surely removed every time. Further, the ink W collected on the cleaning wall 12 is held in the grooves 13, so that the ink W can be prevented from dripping and scattering therefrom.

The inclined plane 14*a*, having the grooves 13, extends from the side 12*b* of the cleaning wall 12, near the end face 12*a*. Therefore, even if an amount of ink W collected on the cleaning wall 12 is small, the ink W can contact the inclined plane 14*a*. The ink W contacting the inclined plane 14*a* is led to the grooves 13. That is, because the inclined plane 14*a*, having the grooves 13, extends from the side 12*b* of the cleaning wall 12, near the end face 12*a*, the ink W collected on the cleaning wall 12 can be surely held by the grooves 13. The height of the inclined plane 14*a* diminishes in the direction reverse to the wiping direction. Therefore, the wiper 86 can contact the cleaning wall 12 in a straight state. The free end of the wiper 86 protrudes higher than the end face 12*a* in the straight state, so that a large part of the wiper 86 can contact the cleaning wall 12. Thus, most of the part of the wiper 86 can be rubbed by the cleaning wall 12, so that the wiper 86 can be further kept clean.

The grooves 13 are continuously formed in the plane 14*b*, that does not contact the wiper 86, so that a large amount of the ink W collected by the cleaning wall 12 can be held. Therefore, the wiper 86 can be cleaned for a long time. The plane 14*b* does not contact the wiper 86, so that the ink W held by the grooves 13 does not adhere to the wiper 86 again. Accordingly, the wiper 86 can be prevented from getting dirty from the collected ink W.

Figure 6B:
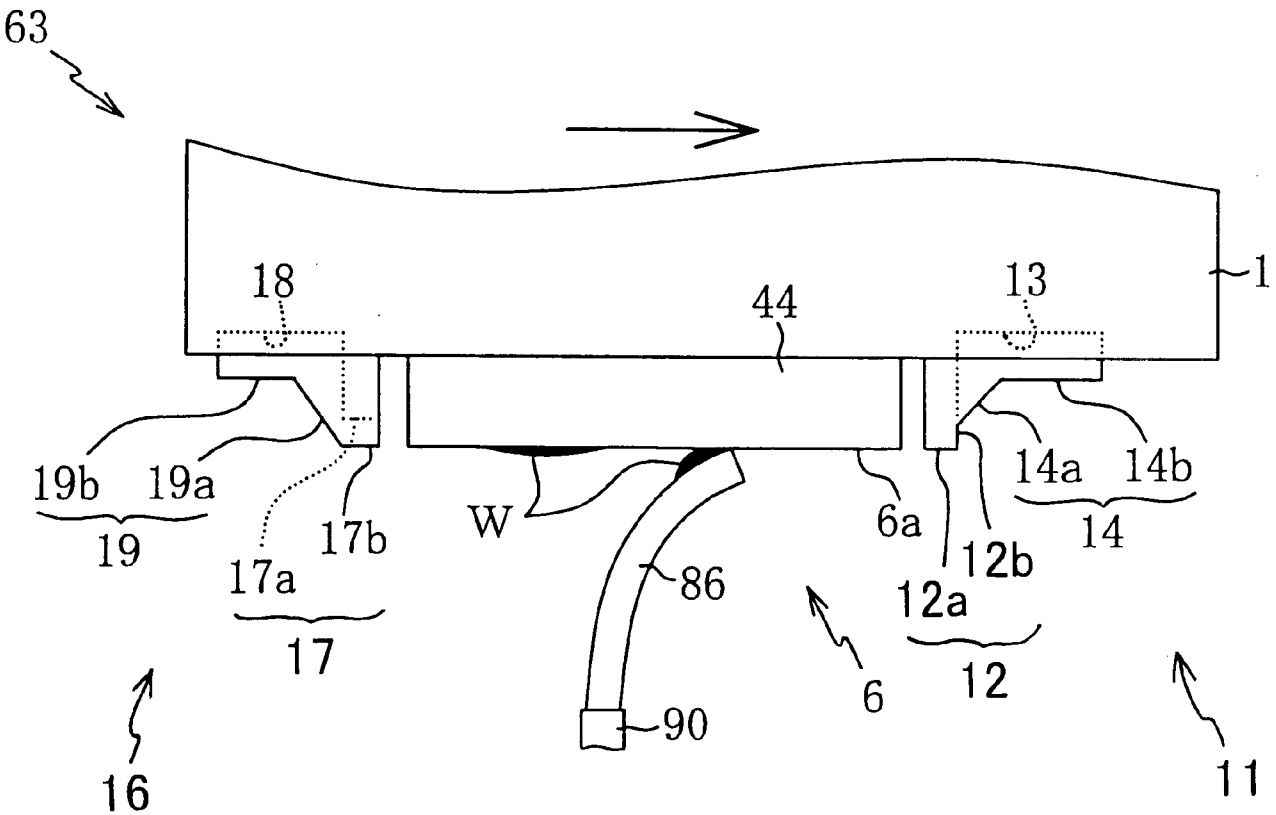

As shown in FIG. 6B, when the ink-jet head 6 is further moved from the position shown in FIG. 6A, the wiper 86 contacts the ink-jet head 6, thereby wiping ink W from the nozzle surface 6*a*. The wiping operation is performed by which the ink-jet head 6 is moved while the wiper 86 is pressed against the nozzle surface 6*a* of the ink-jet head 6. Ink W adhered to the wiper 86 at the last wiping operation is rubbed off before the next wiping operation is performed, so that the wiping operation can be implemented using the clean wiper 86 every time. Accordingly, the ink-jet head 6 can be kept clean and a recording medium can be surely prevented from getting dirt thereon from ink W adhered to the nozzle surface 6*a*, and an occurrence of ink ejection failure can be prevented.

Figure 6C:
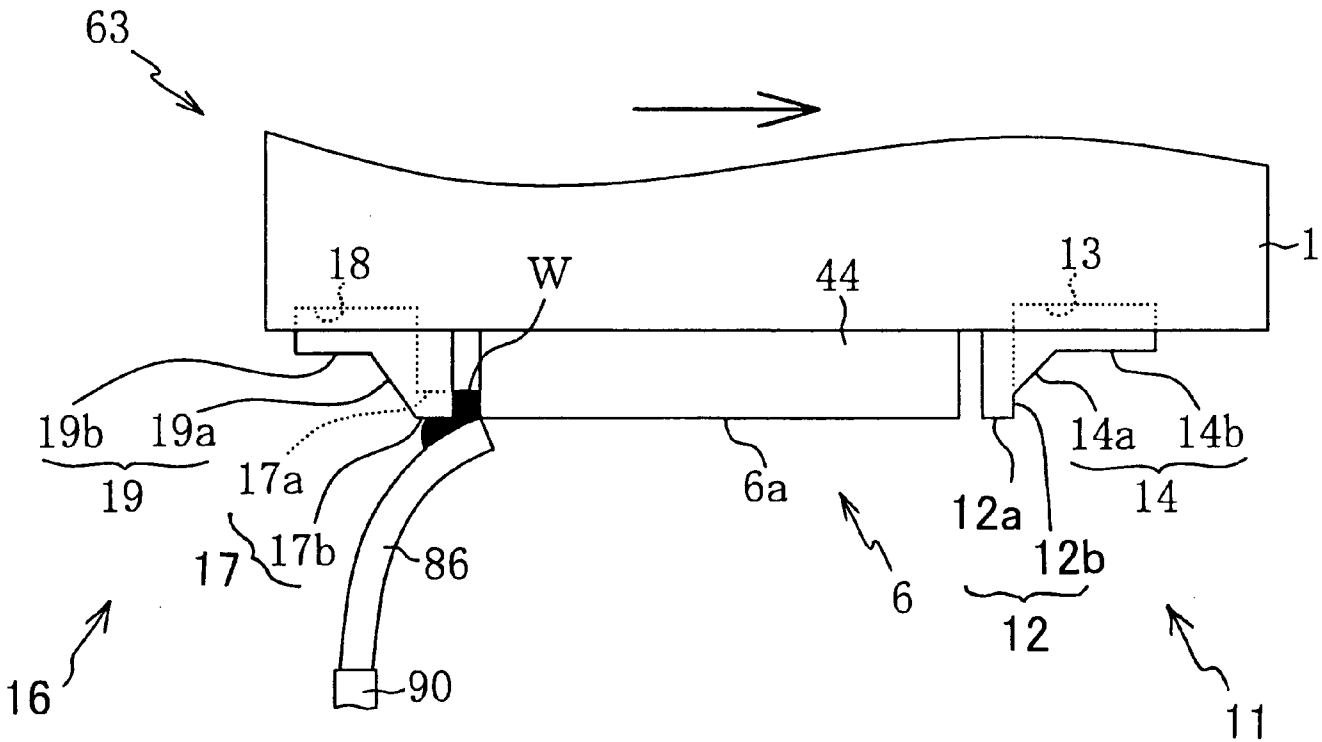

As shown in FIG. 6C, when the ink-jet head 6 is further moved from the position shown in FIG. 6B, the ink W adhered to the nozzle surface 6*a* of the ink-jet head 6 is collected by the wiper 86. The collected ink W is brought toward the projection 17 provided adjacent to the nozzle surface 6*a* of the ink-jet head 6. The ink W is held by capillary action in the recesses 17*a* formed in the end face of the projection 17, and then is led to the grooves 18 connecting with the recesses 17*a*. As described above, the collected ink W is held by the recesses 17*a*, so that little ink W remains on the wiper 86. Therefore, when the wiper 86 returns to the straight state from the bent state, the ink W will not be scattered from the wiper 86.

The recesses 17*a* are provided in the projection 17, facing the ink-jet head 6. A clearance between the ink-jet head 6 and the projection 17*a* communicates with the grooves 18 via the recesses 17*a*. Therefore, ink W entering into the clearance between the ink-jet head 6 and the projection 17 is led to the grooves 18. Thus, the ink W can be prevented from scattering and dripping from the clearance.

The inclined angle of the inclined plane 19*a* is determined such that the bent wiper 86 is to be softly straightened while contacting the inclined plane 19*a* in accordance with the movement of ink-jet head 6. Accordingly, the wiper 86 is prevented from being suddenly released, and thus the scattering of the ink W adhered to the wiper 86 is prevented.

The grooves 18 are continuously formed in the plane 19*b*, that does not contact the wiper 86, so that a large amount of the ink W collected by the wiper 86 can be held. Therefore, the grooves 18 can hold ink W for a long time. The plane 19*b* does not contact the wiper 86, so that the ink W held by the grooves 18 does not adhere to the wiper 86 again. Accordingly, the wiper 86 is prevented from getting dirty from the ink W.

Next, a second embodiment of the invention will be described. In the first embodiment as described above, the wiper cleaning zone 11 and the ink holding zone 16 are integrally provided to the frame 1 of the head unit 63. In the second embodiment, a cleaning zone 111 and an ink holding zone 116 are provided to a carriage 164 as a support member that holds a head unit.

Figure 7:
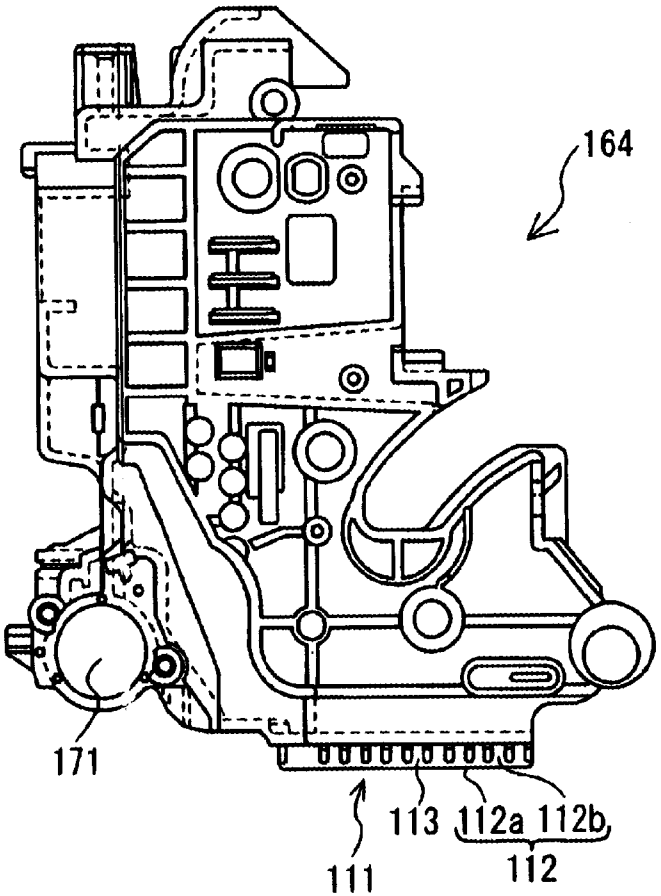
FIG. 7 is a left side view of a carriage of a second embodiment of the invention.

FIG. 7 is a left side view of the carriage 164. The carriage 164 is slidably attached to a carriage shaft 171 so as to reciprocate in a direction orthogonal to a sheet feed direction. The head unit is mounted on the carriage 164.

The wiper cleaning zone 111 is provided at the bottom of the carriage 164, and cleans the wiper 86 before the wiping operation. The wiper cleaning zone 111 includes a cleaning wall 112 and a plurality of grooves 113. The cleaning wall 112 is disposed adjacent to the ink-jet head 106 so as to protrude from the carriage 164. The plurality of grooves 113 are provided continuously from the cleaning wall 112 so as to extend in a direction opposite to the wiping direction.

The cleaning wall 112 rubs contaminants, such as ink and paper dust, from the wiper 86. The plate shape cleaning wall 112 has an end face 112*a* and a side 112*b*. The wiper 86 is cleaned by rubbing with a part of the end face 112*a*. As shown in FIG. 9B, the end face 112*a* of the cleaning wall 112 is provided at substantially the same level as the nozzle surface 106*a*. The grooves 113 hold therein ink collected from the wiper 86 when rubbed against the cleaning wall 112.

Figure 8:
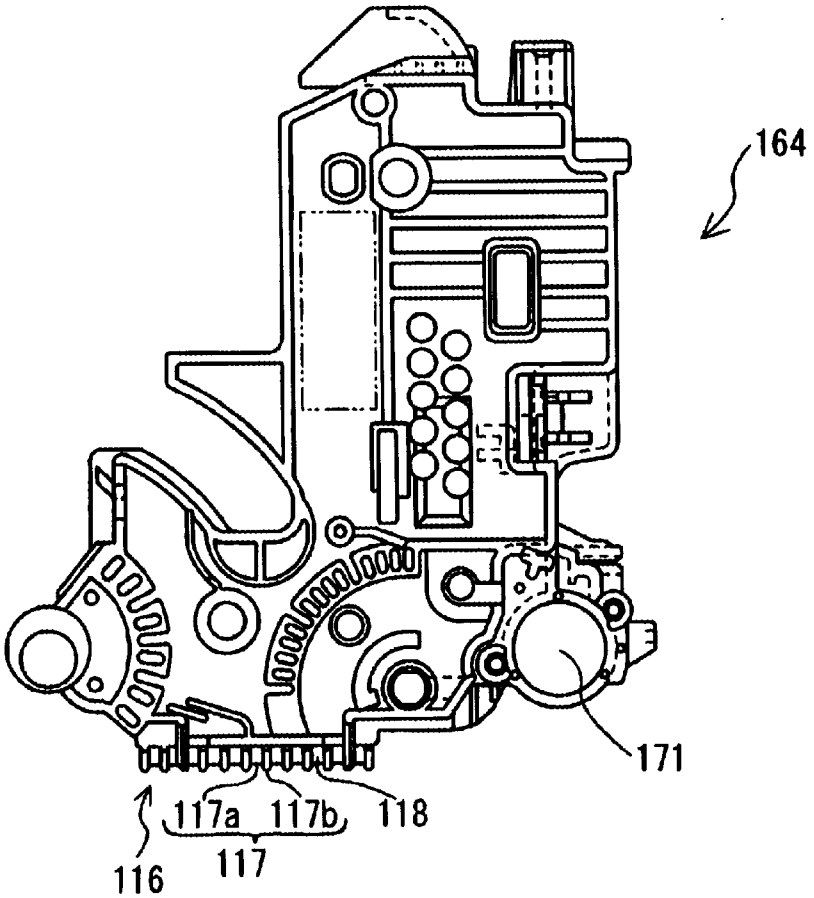
FIG. 8 is a right side view of the carriage.

FIG. 8 is a right side view of the carriage 164. The ink holding zone 116 is provided at the bottom of the carriage 164, and holds ink collected by the wiping operation. The ink holding zone 116 includes a projection 117 and a plurality of grooves 118. The plurality of grooves 118 extend in the wiping direction from the projection 117.

Figure 9A:
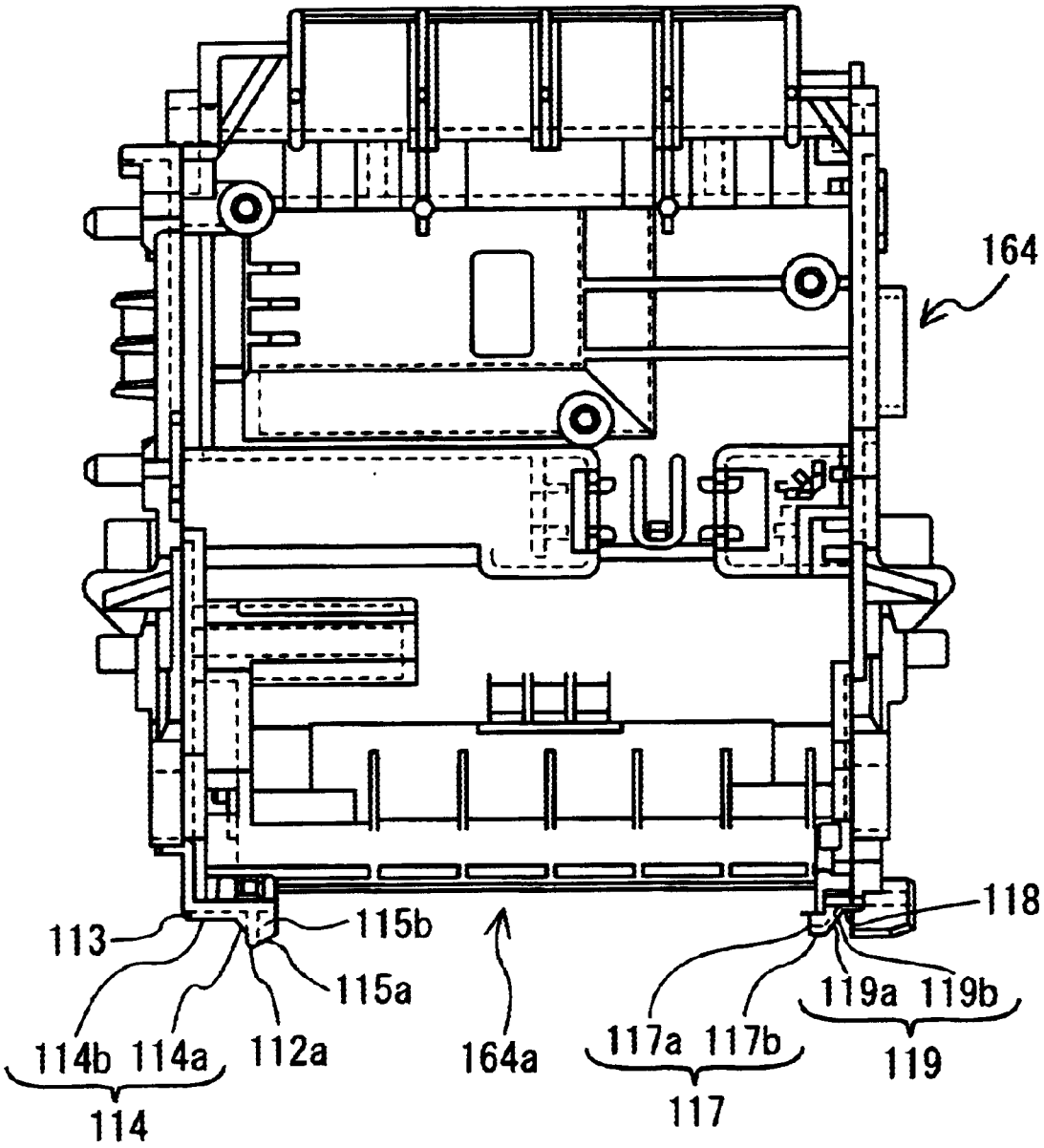
FIG. 9A is a front view of the carriage.
Figure 9C:
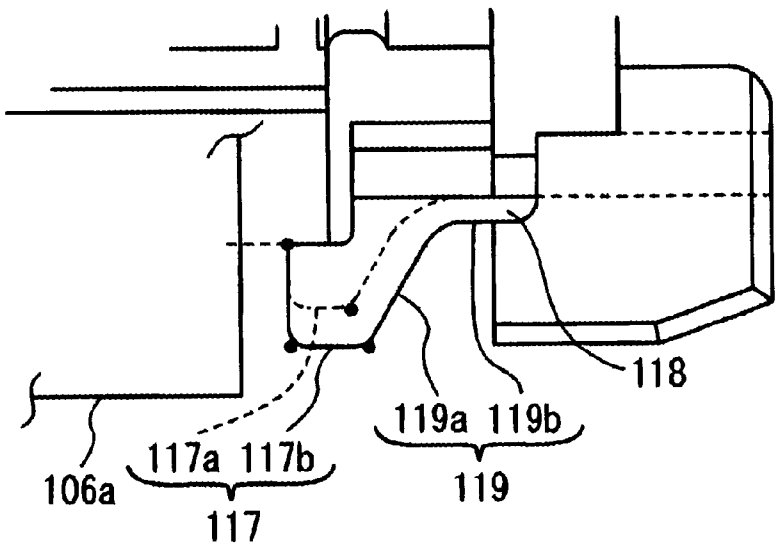
FIG. 9C is an enlarged view of an ink holding zone provided to the carriage.
Figure 9B:
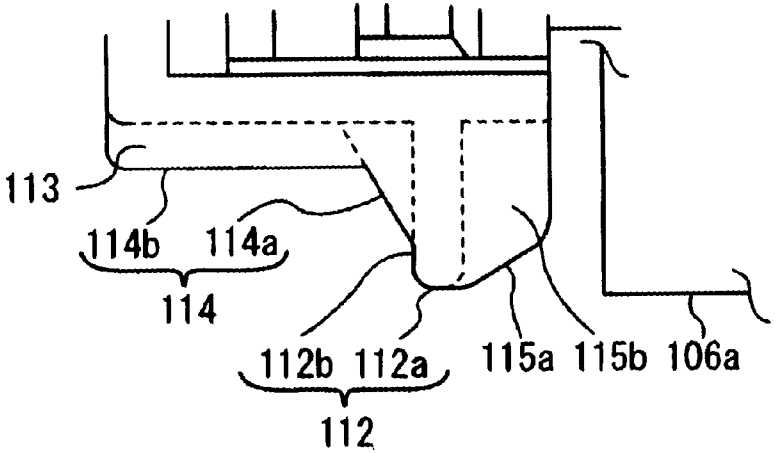
FIG. 9B is an enlarged view of a wiper cleaning zone provided to the carriage.
Figure 10:
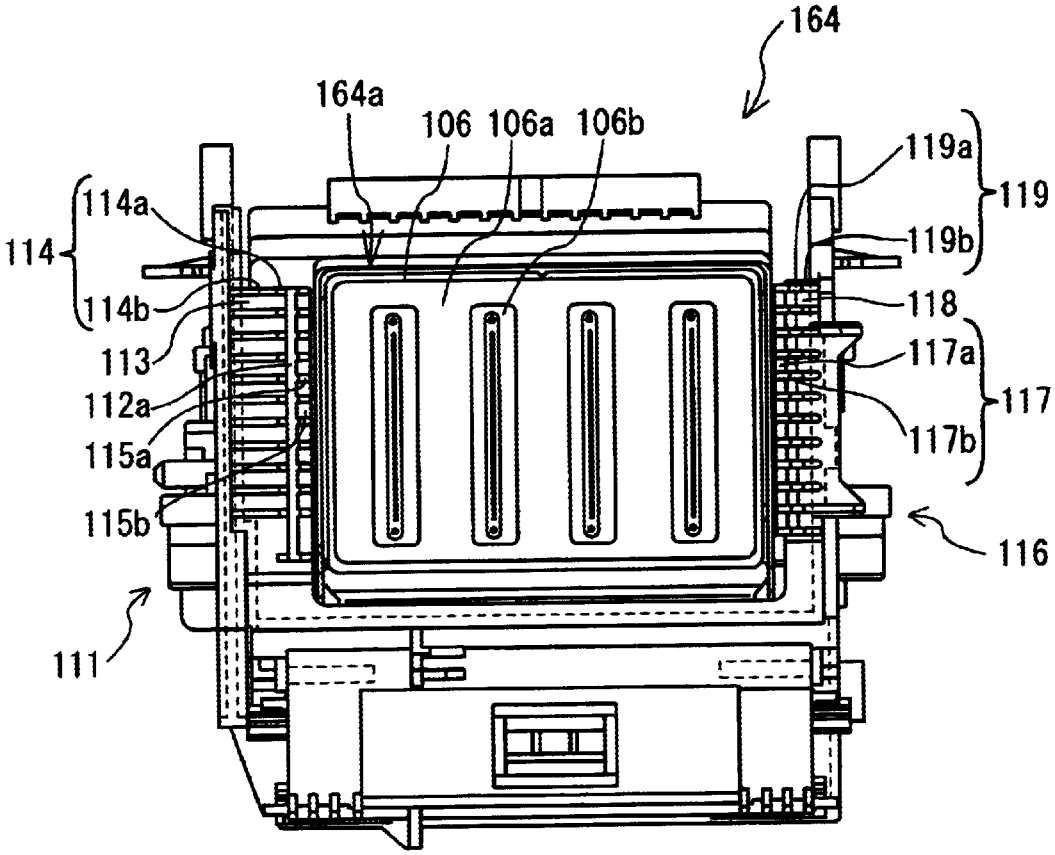
FIG. 10 is a bottom view of the carriage to which an ink-jet head is attached.

FIG. 9A is a front view of the carriage 164. FIG. 9B is an enlarged view of the wiper cleaning zone 111 provided to the carriage 164, and FIG. 9C is an enlarged view of the ink holding zone 116 provided to the carriage 164. FIG. 10 is a bottom view of the carriage 164 to which the ink-jet head 106 is attached.

As shown in FIG. 10, the ink-jet head 106 is mounted on the carriage 164 such that the nozzle surface 106*a* is placed between the wiper cleaning zone 111 and the ink holding zone 116 and a plurality of nozzles 106*b* are exposed from an opening portion 164*a* of the carriage 164.

As shown in FIGS. 9A and 9B, the grooves 113 are formed in a first surface 114 which is provided at a lower level than the end face 112*a* of the cleaning wall 112. The grooves 113 extend from the side 112*b* of the cleaning wall 112 in the direction opposite to the wiping direction, and are provided at regular intervals, in parallel to each other. The first surface 114 having the grooves 113 extends continuously from the side 112*b* of the cleaning wall 112. The first surface 114 has an inclined plane 114*a* and a plane 114*b*. The height of the inclined plane 114*a* gradually and continuously diminishes in the direction opposite to the wiping direction. The plane 114*b* extends from the end of the inclined plane 114*a*, in parallel with the nozzle surface 106*a* of the ink-jet head 106, toward the side of the carriage 164. When the wiper 86 protrudes within a moving path of the ink-jet head 106 at the wiping operation, the free end of the wiper 86 contacts a part of the inclined plane 114*a* formed immediately adjacent to the cleaning wall 112 only, but does not contact the plane 114*b*.

The end face 112*a* in the wiper cleaning zone 111 has elongated portions 115*a* that extend in the wiping direction at positions corresponding to the first surface 114. A plurality of second grooves 115*b* are provided between the elongated portions 115*a* at a position corresponding to the grooves 113 in the first surface 114. With this structure, when ink wiped by the wiper 86 arrives at the end face 112*a* during the wiping operation, the second grooves 115*b* hold the ink.

As shown in FIGS. 9A and 9C, the projection 117 is provided adjacent to the ink-jet head 106. The projection 117 protrudes from the support member so as to project no higher than the level of the nozzle surface 106*a* of the ink-jet head 106. A plurality of recesses 117*a* are formed in the end of the projection 117 at predetermined intervals to hold ink. The end of the projection 117 has intermittent projecting surfaces 117*b*.

The grooves 118 hold ink received by the recesses 117*a*. The grooves 118 extend in the wiping direction from the projection 117 and are provided at regular intervals and in parallel to each other. A second surface 119 extends continuously from the projection 117 in the wiping direction. The grooves 118 are formed in the second surface 119. The second surface 119 has an inclined plane 119*a* and a plane 119*b*. The inclined plane 119*a* extends from the end face 117*b*, and the height of the inclined plane 119*a* gradually and continuously diminishes in the wiping direction. The plane 119*b* extends from one end of the inclined plane 119*a* and is parallel to the nozzle surface 106*a*. When the wiper 86 protrudes within the moving path of the ink-jet head 106 at the wiping operation, the free end of the wiper 86 contacts a part of the inclined plane 119*a* formed immediately adjacent to the projection 117 only, but does not contact the plane 119*b*.

While the invention has been described in detail with reference to a specific embodiment thereof, it would be apparent to those skilled in the art that various changes and modifications may be made therein without departing from the spirit of the invention.

In the embodiment, the color ink-jet printer 100 is used as an ink-jet recording apparatus. However, the invention is not restricted to the specific embodiment. For example, the invention can be applied to ink-jet type copying machines and facsimile machines. In the embodiment, four ink cartridges 61 are attached to the color ink-jet printer 100. However, the ink-jet printer 100 may be structured so that a predetermined number of ink cartridges, at least one, can be attached.

In the embodiment, the ink-jet head 6 is disposed so that the nozzle surface 6*a* faces vertically downward. However, the nozzle surface 6*a* may face in the horizontal direction or vertically upward. Further, the nozzle surface 6*a* may be inclined.

In the embodiment, while the wiper cleaning zone 11 and the ink holding zone 16 are integral with the frame 1, the wiper cleaning zone 11 and the ink holding zone 16 may be provided separately from the frame 1.

What is claimed is:

1. An ink-jet recording apparatus, comprising:

an ink-jet head that has a nozzle surface having a plurality of nozzles therein and performs printing on a recording medium by ejecting ink from the nozzles;

a support member that supports the ink-jet head and reciprocates along the recording medium;

a wiper that protrudes within a moving path of the nozzle surface of the ink-jet head and wipes the nozzle surface when the support member moves in a wiping direction;

a wiper cleaning zone that is provided to the support member upstream of the nozzle wiping direction with respect to the nozzle surface of the ink-jet head; the wiper cleaning zone comprising:

a cleaning wall that is provided adjacent to the ink-jet head and protrudes from the support member;

a first plane that extends from proximate the cleaning wall in a direction opposite to the wiping direction; and a plurality of grooves provided in the first plane, at a predetermined distance from each other; wherein the wiper does not contact the first plane, but contacts the cleaning wall when the wiper protrudes within the moving path of the nozzle surface of the ink-jet head.

2. The ink-jet recording apparatus according to claim 1, wherein the wiper cleaning zone further comprises a second plane that is provided between the cleaning wall and the first plane, wherein a height of the second plane gradually and continuously diminishes in the direction reverse to the wiping direction, and the plurality of grooves are provided in the first and second planes continuously from the cleaning wall.

3. The ink-jet recording apparatus according to claim 1, the cleaning wall is provided at a predetermined distance away from the ink-jet head.

4. The ink-jet recording apparatus according to claim 1, wherein the plurality of the grooves extend in a direction parallel to a support member reciprocation direction.

5. The ink-jet recording apparatus according to claim 4, wherein the cleaning wall has a side, and the plurality of the grooves are provided continuously from the side of the cleaning wall.

6. The ink-jet recording apparatus according to claim 5, wherein an opening width of each of the plurality of the grooves becomes narrow toward the support member.

7. The ink-jet recording apparatus according to claim 1, further comprising:

an ink holding zone that is provided to the support member, adjacent to the ink-jet head, downstream of the nozzle wiping direction with respect to the nozzle surface of the ink-jet head, the ink holding zone comprising:

a projection that is provided adjacent to the ink-jet head and protrudes from the support member, and has a plurality of recesses provided at a predetermined distance therebetween;

a third plane that extends from proximate the projection in the wiping direction;

a plurality of grooves provided in the third plane at a predetermined distance therebetween, the plurality of grooves provided continuously from the plurality of recesses;

wherein the wiper does not contact the third plane, but contacts the projection, when the wiper protrudes within the moving path of the nozzle surface of the ink-jet head.

8. The ink-jet recording apparatus according to claim 7, wherein the ink holding zone further comprises a fourth plane that is provided between the projection and the third plane, wherein height of the fourth plane gradually and continuously diminishes in the wiping direction, and the plurality of grooves are provided in the third and fourth planes continuously from the plurality of the recesses.

9. The ink-jet recording apparatus according to claim 7, wherein the projection is provided at a predetermined distance away from the ink-jet head.

10. The ink-jet recording apparatus according to claim 7, wherein the plurality of the grooves extends in a direction parallel to a support member reciprocation direction.

11. The ink-jet recording apparatus according to claim 10, wherein an opening width of each of the plurality of the grooves becomes narrow toward the support member.

12. The ink-jet recording apparatus according to claim 7, wherein the projection protrudes from the support member so as to project to a level no higher than a level of the nozzle surface of the ink-jet head.

13. The ink-jet recording apparatus according to claim 7, wherein the projection protrudes from the support member so as to be substantially the same height as a level of the nozzle surface of the ink-jet head.

14. The ink-jet recording apparatus according to claim 1, wherein the cleaning wall protrudes from the support member so as to be substantially the same height as a level of the nozzle surface of the ink-jet head.

15. A printhead wiping apparatus, comprising:

a wiper blade movable toward and away from a plane defined by movement of a nozzle surface of a printhead;

a cleaning zone upstream of the printhead relative to the movement of the printhead relative to the wiper blade, the cleaning zone comprising:

a planer surface inclined to recede from the plane in a direction toward upstream the inclined planer surface having a plurality of grooves; and a cleaning wall having an end surface lying in the plane and a side wall from which the inclined planer surface extends, the start of the inclined planer surface offset from the end surface; and an ink holding zone downstream of the printhead relative to the movement of the printhead relative to the wiper blade, the ink holding zone having a plurality of projections alternating with a plurality of recesses.

16. The printhead wiping apparatus according to claim 15, wherein the cleaning zone further comprises a flat planer surface substantially parallel to the nozzle surface, the inclined planer surface terminating at the flat planer surface.

17. The printhead wiping a apparatus according to claim 16, wherein the flat planer surface has a plurality of grooves aligned with and connecting to the plurality of grooves of the inclined planer surface.

18. The printhead wiping apparatus according to claim 17, wherein each groove has a greater width at the planer surface than at a bottom surface.

19. The printhead wiping apparatus according to claim 16, wherein the wiper blade when moved toward the plane passes through the plane to a point between the plane and the flat planer surface.

20. The printhead wiping apparatus according to claim 16, wherein the ink holding zone further comprise an inclined planer surface that recedes from the plane and the plurality of projections in a direction toward downstream, the inclined planer surface having a plurality of grooves corresponding to positions of the recesses.

21. The printhead wiping apparatus according to claim 20, wherein the ink holding zone further comprises a flat planer surface substantially parallel to the nozzle surface, the inclined planer surface terminating at the flat planer surface.

22. The printhead wiping apparatus according to claim 21, wherein the flat planer surface has a plurality of grooves aligned with and connecting to the plurality of grooves of the inclined planar surface.

23. The printhead wiping apparatus according to claim 22, wherein each groove has a greater width at the planar surface than at a bottom surface.

24. The printhead wiping apparatus according to claim 21, wherein when the wiper blade clears the projections, the wiper blade passes down the inclined planar surface of the ink holding zone to a point between the plane and the flat planar surface of the ink holding zone prior to retraction from the plane.

25. The printhead wiping apparatus according to claim 15, wherein the cleaning zone and the ink holding zone are separated from the printhead.

* * * * *